United States Patent [19]

Roessiger

[11] Patent Number: 4,967,952

[45] Date of Patent: Nov. 6, 1990

[54] SELF-WRAPPED BOX

[75] Inventor: Claude Roessiger, Walfeboro, N.H.

[73] Assignee: PAK 2000 div. of Ocor Products Corp., Mirror Lake, N.H.

[21] Appl. No.: 386,596

[22] Filed: Jul. 31, 1989

[51] Int. Cl.[5] ..... B65D 65/12

[52] U.S. Cl. ..... 229/87.19; 229/923

[58] Field of Search ..... 229/87 R, 923

[56] References Cited

U.S. PATENT DOCUMENTS

| | | | |
|---|---|---|---|
| 2,294,690 | 9/1942 | Perry | 229/87 R |
| 3,391,856 | 7/1968 | Siegler | 229/87 R |
| 3,451,611 | 6/1969 | Adams, Jr. | 229/87 R |
| 3,459,358 | 8/1969 | Adams, Jr. | 229/87 R |
| 3,460,738 | 8/1969 | Adams, Jr. et al. | 229/87 R |
| 3,790,069 | 2/1974 | Straccamore | 229/87 R |
| 3,829,005 | 8/1974 | Hackenberg et al. | 229/923 X |
| 3,851,815 | 12/1974 | Desmond et al. | 229/87 R |
| 4,005,814 | 2/1977 | Foster | 229/87 R X |

*Primary Examiner*—Stephen Marcus
*Assistant Examiner*—Jes F. Pascua
*Attorney, Agent, or Firm*—Philip Furgang

[57] ABSTRACT

A wrapping of a selected material, preferably with a decorated surface, is adhered to selected areas of the outer surface of a box within which an item is to be placed. The box is substantially tubular with spaced sides and open at at least one end. The box is provided with a closure for each end and the wrapping material is secured to a portion of the closure that is the last portion thereof to be closed when closing the box end. The wrapping is furthermore embossed along selected lines to facilitate its forming a wrap closure for the box ends. The box ends are closed and the wrap ends are folded into a closed condition presenting the appearance of a hand wrapped box. The adhesion of the wrapping to the box surface is selected to encompass an area of no more than ten percent of the overlapped area and as such further enhances the hand wrapped appearance by presenting a loose appearance for the wrapping on the box.

14 Claims, 2 Drawing Sheets

SELF-WRAPPED BOX

BACKGROUND OF THE INVENTION

Field of Application

This invention relates to packages and boxes; and more particularly, to packages and boxes which are pre-wrapped or self-wrapped.

Description of the Prior Art

It is often desirable when giving a gift or present to have the item boxed or otherwise placed in a distinctive package other than the normal packaging provided for the item. Some items, especially items of clothing or other wearing apparel, quite often are not even offered with any form of packaging but are merely placed in a bag when sold.

Presenting a gift item or present in a box enhances the presentation and is often regarded by the recipient as one further thought and act demonstrating that the person cared. However, most boxes provided by stores, especially department stores, are in an established or recognized store color and/or design. While they are distinctive and, at times, better than just putting the item in a bag, they often do not in and of themselves make an aesthetically pleasing gift presentation.

The gift giver may want to present the gift not only boxed but also distinctively wrapped in a particular colored paper which might be their favorite color or one of the favorite colors of the person receiving the gift. The gift may be for a special occasion such as a birthday, shower, wedding anniversary or the like and it may be the desire of the gift giver that the box be wrapped in a gift-wrap indicating the occasion. The gift may otherwise be being made at a particular time of the year such as Christmas, Easter, Valentines Day or similar holidays and the gift giver may want the box gift wrapped to reflect that situation.

Many stores will not only provide a gift box free with a purchase but they may also provide gift wrap paper (foil, etc.) free as well. Whether the gift wrap is free or is purchased from wide selections of available gift wrappings still requires for many that the item be properly boxed and thereafter gift-wrapped so as to present a hand gift-wrapped appearance. Unfortunately, a great many people lack either the ability, the know-how or the time to wrap a boxed item so as to present a hand gift-wrapped appearance.

Here again stores, department stores, and available services are available to gift-wrap presents. At time the service is free and at other times there is a nominal charge when the gift-wrapping is accomplished at the store where the item of merchandise is purchased. But for many occasions, especially during the holiday periods such as Christmas, Valentines Day and the like the gift-wrap counter may be, and often is backed up because hand gift-wrapping is a time consuming chore. The over-wrap paper, foil, etc., must be selected, cut to approximate size, aligned with the boxed item and thereafter wrapped about the box with the ends of the wrap closed and sealed so as to present that desired "hand gift-wrapped" appearance.

Merchants have made efforts to bypass or avoid the time, expense and aggravation of hand gift-wrapping by providing decorative packaging which does not require hand attention. However, packages such as shown in U.S. Pat. No. 2,207,567 to Warner and in U.S. Pat. No. 3,729,126 granted on Apr. 24, 1973 to G. M. Donahue for *Decorative Carton With Removable Band And Blank Therefor* fail to meet the hand gift-wrapped appearance test.

Other attempts have been made to provide pre-wrapped or self-wrapped boxes. However, those which are fabricated as shown and described in U.S. Pat. No. 3,451,611 granted on June 24, 1969 to L. Adams Jr. for *Prewrap Carton For High-Speed Erection* require the overwrap to be affixed to the carton end-flaps and, as such present a relatively bulky appearance as opposed to a hand gift-wrapped appearance for the end flaps. In addition, the prescribed attachment or binding of the wrap to the container along many areas and lines detracts from a desired "loose wrap" appearance for a simulated hand gift-wrapped package. Packaging of the type shown and described in U.S. Pat. No. 3,829,005 granted on Aug. 13, 1974 to R. A. Hackenberg, et al for *Folding Container With Folding Closure Ends* also secure the overwrap to the box at too many locations and too extensively while further resulting in a wrapped package with relatively bulky looking end closures because the overwrap must by disposed both on top and beneath end closure members. In addition, the wrapping procedure dictates boxes with specially cut end closures which add to cost and diminish available boxes for use as pre-wrapped boxes. Overwrapped packaging such as shown in U.S. Pat. No. 4,005,814 granted on Feb. 1, 1977 to T. W. Foster for *Carton With Integral Overwrap* requires a box or carton construction with slits and tabs to effect container closure. The resulting container end flaps are, as for previously described prior art containers, so interfoled with the overwrap as to present a relatively bulky and not hand gift-wrapped appearance and the person effecting the final wrapping is in no way guided by the container closing sequence into the container wrapping sequence.

SUMMARY OF THE INVENTION

It is therefore an object of this invention to provide a new and improved container.

It is another object of this invention to provide a new and improved self-wrapped box or container.

It is yet another object of this invention to provide a new and improved gift-box.

It is still another object of this invention to provide a new and improved self-wrapped gift box.

It is yet still another object of this invention to provide a new and improved self-wrapped box which when in its closed and wrapped condition presents the appearance of a hand gift-wrapped container.

This invention involves boxes and gift boxes of the pre-wrapped or self-wrapped type; and more specifically contemplates securing the wrap (or over-wrap) to the underlying container or box at selected and predetermined areas to thereby establish a loose-wrapped appearance and furthermore contemplates so securing the wrap to the box such that closure of the box initiates the wrap procedure which results in a wrapped container with a hand gift-wrapped appearance.

Other objects, features, and advantages of the invention in its details of construction and arrangement of parts will be seen from the above, from the following description of the preferred embodiment when considered with the drawing and from the appended claims.

BRIEF DESCRIPTION OF THE DRAWING

In the drawing:

FIG. 2 is a perspective of one end of the container and self-wrap of FIG. 1 but showing its end flaps in closed condition;

FIG. 1 is a perspective of the end of the container and self-wrap of FIG. 2 but showing the closure flap in closed condition over the end flap;

DESCRIPTION OF THE PREFERRED EMBODIMENT

Figure 1:
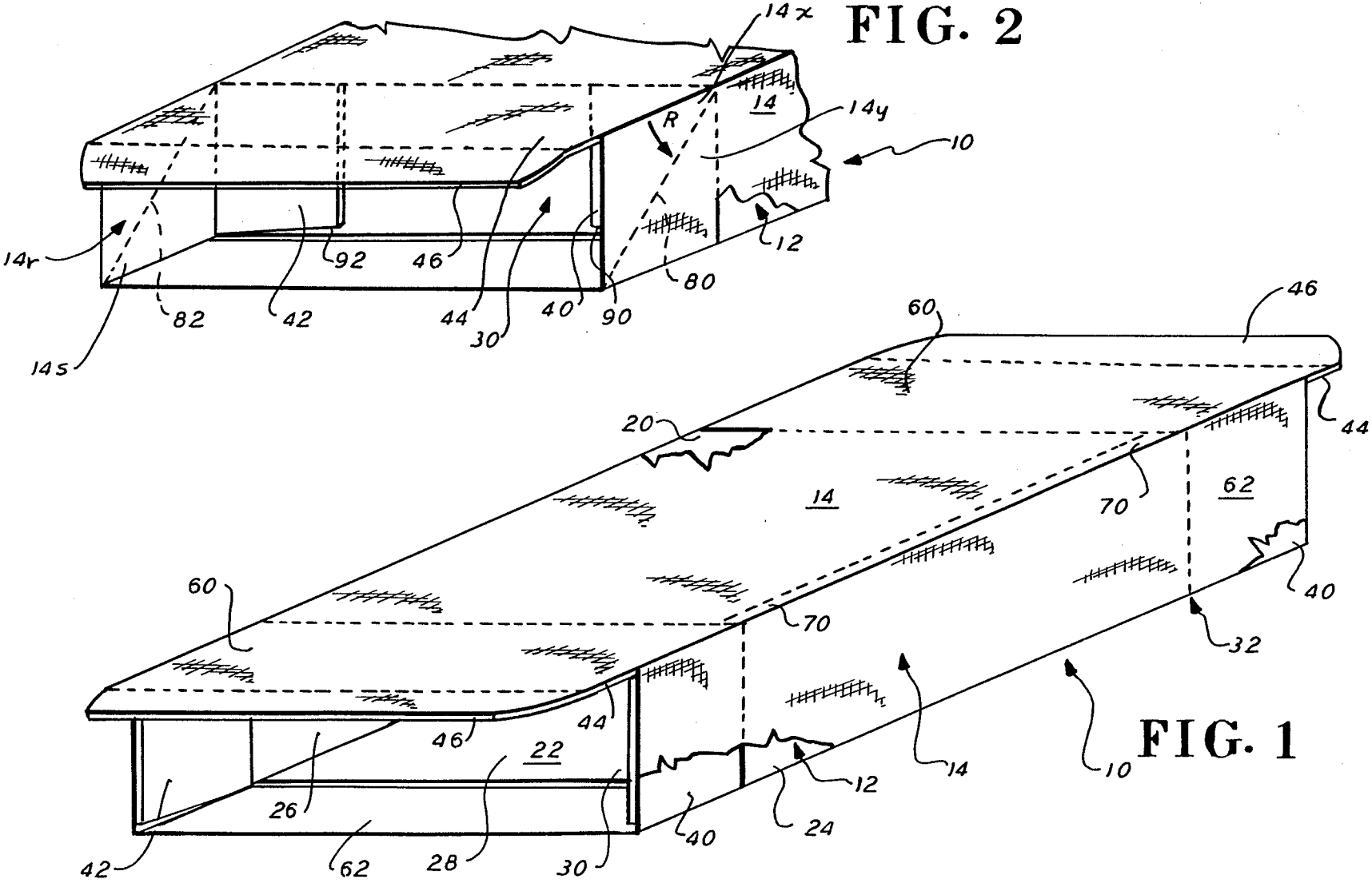
FIG. 1 is a perspective of a container or box provided with a self-wrap incorporating the instant invention and showing same with closure ends both open.

With reference to FIG. 1, there is generally shown at 10 a self-wrapped container or box including a box or container portion 12 and a wrap or over-wrap portion 14. Box portion 12 is of conventional construction and includes a set of opposed and spaced front and back panels 20, 22 respectively that are connected together, in spaced relationship by a pair of spaced side panels 24, 26 respectively. Panels 20, 22, 24 and 26 are fabricated from materials usually utilized to form cartons, containers and boxes such as cardboard and similar materials and are of a size and configuration to form therebetween when assembled together a space 28 of a size and configuration to receive what is to be boxed. Panels 20–26 are connected together into the desired configuration by suitable means such as an adhesive and in conventional manner.

Container or box portion 12 is open at its respective ends 30, 32 but is provided thereat with a box end closure or closing means including a pair of end flaps 40, 42 and an end closure 44 which includes an end tab 46. The box end closure means for container end 32 is identical in construction to that of the end closure means just described for container end 30. It is important to note that end closures 44 for the end closure means at both ends 30 and 32 both extend from container panel 20. This, as will be hereinafter explained, facilitates a wrap closure that is symmetrical for both ends of package 10. If such a symmetrical wrap closure is not desired then the end closures 44 at opposed ends of container 10 may extend from opposite body panels 20, 22 (i.e. for body panel 20 end closure 44 would be as shown; while end closure 44 for end 32 would extend from body panel 22). The preferred configuration is as shown in FIG. 1.

Wrap or overwrap portion 14 may be selected from any grade or quality of material suitable for wrapping purposes. While in general it is a suitable gift wrap type substance it need not be. When selected for a gift-wrap material 14 may be any suitable color or mixture of colors and/or it may be otherwise designed or patterned. Wrap 14 may carry words or phrases suitable for specific occasions (such as weddings, birthdays, or holidays). The material for wrap 14 may be paper, plastic, foil or the like and it may be prepared in any suitable and conventional way by screening, printing or other suitable and appropriate processes.

Wrap portion 14 is sized to completely encapsulate and cover the outer surfaces of body panels 20, 22 and side panels 24, 26. In addition wrap portion 14 includes end portions, extensions or wrap end closure or closing means 60 that are sized and configured to cover end closures 44 and their tabs 46 and end portions 62 that are sized to form end closure cover flaps for container 10 as will be hereinafter explained in greater detail.

Wrap portion 14 is secured to the outer surface of container portion 12 in a manner which provides for a "loose appearance" and thus enhances the hand gift-wrapped appearance of container 10. To accomplish this an area 70 of a suitable adhesive is applied between adjacent surfaces of the wrap portion 14. In addition, extensions 60 of wrap portion 14 are secured to underlying end closures 44 thereof by suitable adhesive. Wrap portion 14 and container or box portion 12 are secured together only at areas constituting no more than ten percent of the totel area of wrap portion 14. Wrap portion 14 may be pre-scored or embossed by suitable means and conventional processes along lines 80, 82 (FIG. 2) lines 84, 86 (FIG. 3) and along lines corresponding to edges of container 12 to facilitate closing wrap portion 14 about container portion 12. The closing of the respective ends 30, 32 of container 10 is accomplished in identical manner and so only the closing of end 30 will be described in detail. After container 10 has been set up so that body portion 12 thereof is arranged in tubular fashion the item to be boxed is disposed in space 28 between panels 20–26 (FIG. 1). End flaps 40 and 42 (FIGS. 1 and 2) are rotated from their FIG. 1 condition to that of FIG. 2 to partially close end 30 of container portion 12. End closure 44 is rotated in the direction of arrow "R" (FIG. 2) and tab 46 thereof is rotated in the direction of arrow "R" with respect to the rest of end closure 44. The lower edges of end flaps 40, 42 are cut off at 90, 92 (FIG. 2) to accommodate tab 46 so that as end closure 44 moves into its end closed position (FIG. 3) tab 46 thereof will move through cut-offs 90, 92 and under end flaps 40, 42.

Figure 3:
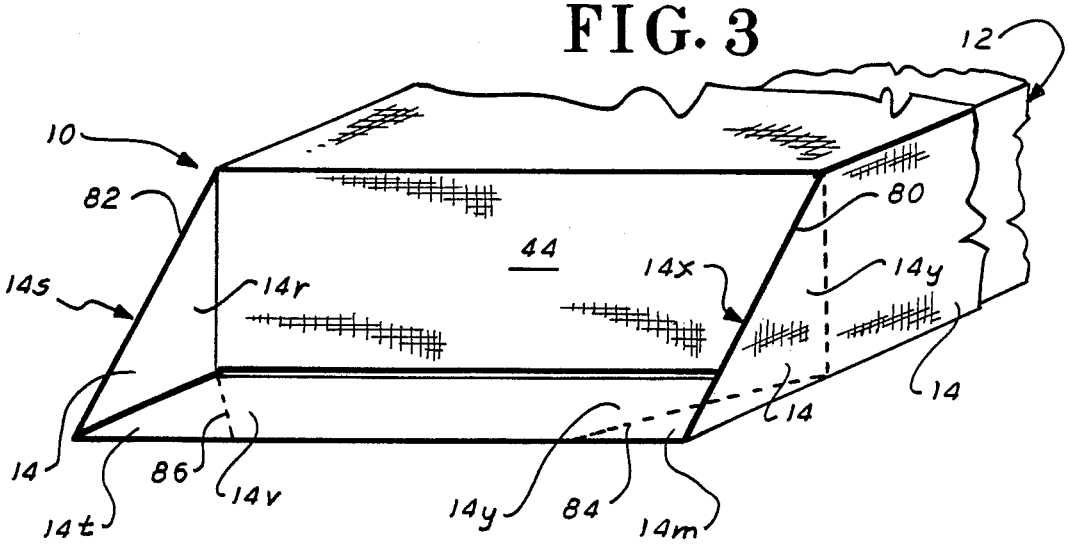

As end closure 44 moves into its end closed (FIG. 3) position it takes with it wrap end portion 60 of wrap portion 14 since wrap end portion 60 is secured to end closure 44. Wrap portion 14 will, however, bend inwardly about fold lines 80, 82 (FIG. 2) and fold inwardly and against itself as shown in FIG. 3 with wrap end portions 14*x* folded against a wrap end portion 14*y* and a wrap end portion 14*r* folded against a wrap end portion 14*s*. Thus the action of end closure 44 in moving to its end closed position initiates the end wrapping of wrap portion 14 about container portion 12.

Figure 4:
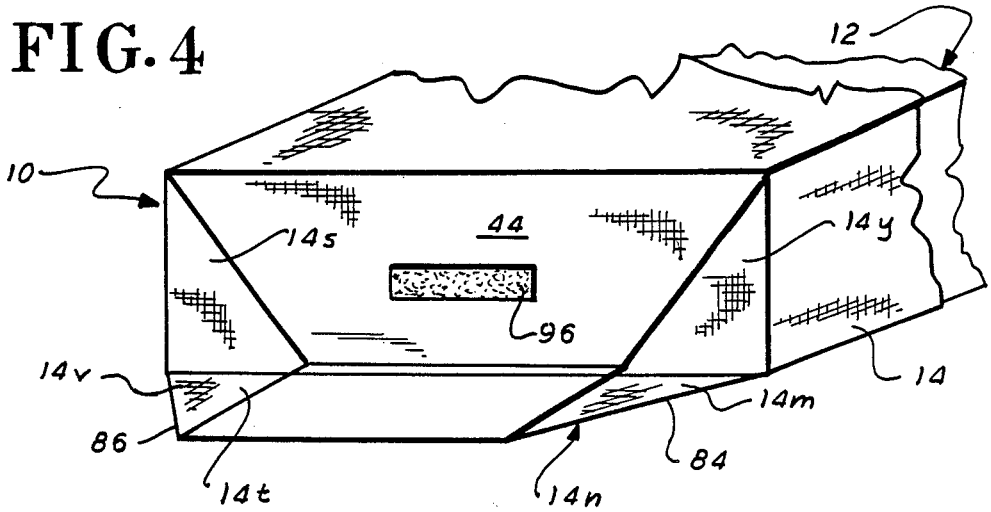
FIG. 4 is a perspective of the end of the container and self-wrap of FIG. 3 but showing partial closing of the self-wrap ends.
Figure 5:
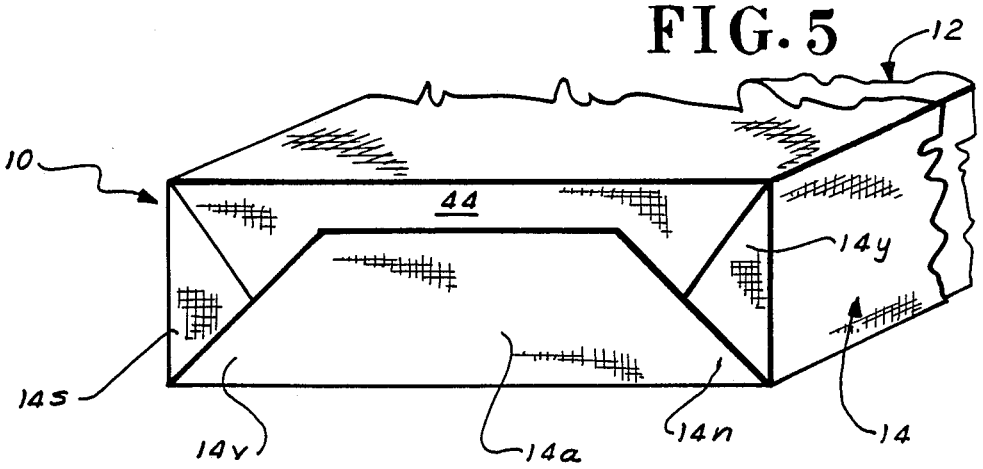
FIG. 5 is a perspective of the end of the container and self-wrap of FIG. 4 but showing full closure of the self-wrap ends at this container end.

Wrap end portions 14*x–y* and 14*r–s* are thereafter pressed inwardly and moved from their FIG. 3 positions to their FIG. 4 positions. Fold lines 84, 86 and adjacent fold lines at the respective corners of wrap 14 facilitate folding of wrap portions 14*m* onto wrap portion 14*n* and of wrap portion 14*t* onto 14*v* as portion 14*x–y* and 14*r–s* move against end closure 44. To complete closure and wrapping of end 30 of container 10 all that remains is to fold the remaining portion 14*a* of wrap portion 14 up and against end closure 44 and to secure same in place. Securing end 14*a* in place may be accomplished by use of a piece of plastic tape, or by having an area, such as area 96 (FIG. 4) of pressure sensitive adhesive pre-deposited onto the surface of wrap portion 14 and covered by a release paper or the like. Other suitable adhesives and manners of affixing end 14*a* of wrap 14 in place may be utilized.

End 32 may be thereafter closed in the same manner and following the same steps as described above for closing end 30. If desired the item to be placed in container 10 may be placed therein before either end 30, 32 have been closed or after one of such end have been closed.

This invention further contemplates that one end (either end 30 or end 32) of container 10 may be closed in the process of setting up containers 10 for subsequent use. Thus thereafter the party wrapping the package will only need to insert the item to be packaged into the open space between the closed end and the container panels and then close only the one open end of container 10 as hereinabove described.

From the above description it will thus be seen that there has been provided a unique and different self-wrapped box which presents a hand wrapped appearance.

It is understood that although I have shown the preferred embodiments of my invention that various modifications may be made in the details of thereof without departing from the spirit as comprehended by the following claims.

What is claimed is:

1. A self-wrapped box; comprising:

(a) box means including a plurality of body panels connected together and defining therebetween a space of predetermined size and configuration and which is open at at least one of two opposed and spaced ends;

(b) said box means further including box end closure means for respectively closing said spaced ends;

(c) wrap means covering said box means and being secured thereto in a predetermined manner and at selected locations so as to present a "loose wrapped" appearance therefore;

(d) said wrap means further including wrap end closing means for covering said box end closure means;

(e) at least a portion of said wrap end closing means being secured to at least a portion of said box end closure means;

(f) said portion of said box end closure means to which said portion of said wrap end closing means is secured to be the last portion of said box end closure means moved to a box closed position when closing the box;

(g) said portion of said wrap end closing means being secured to said box end closure means so as to be the first portion of the wrap end closure means moved to a box wrapped position when wrapping the box;

(h) said box end closure means and said wrap means coacting, upon movement of said box end closure means towards and into a box closed position to initiate a movement of said wrap end closing means towards and into a position to wrap the box end;

(i) said wrap end closing means being disposed in a closed condition by manipulation of portions of said wrap end closing means in a predetermined order and sequence, including folding a first wrap end portion against a portion of said box end closure means, thereafter folding second and third spaced wrap end portions against said folded first wrap end portion and thereafter folding a remaining wrap end portion against the already folded first wrap end portion and second and third wrap end portions and securing said remaining wrap end portion in place;

(j) said wrap end closing means having fold lines formed therein to facilitate said folding thereof; and (k) said fold lines being formed by embossing said wrap end closing means along selected lines which are to correspond to lines about which said wrap end closing means will fold.

2. The self-wrapped box of claim 1, wherein said selected locations at which said wrap means are secured to said box means includes only said box end closure means.

3. The self-wrapped box of claim 1, wherein said box end closure means includes a pair of end flaps which fold from a box open to a box closed position and a box closure which folds from a box open to a box closed position and which in said box closed position is of a size and configuration to close its respective box end.

4. The self-wrapped box of claim 3, wherein said wrap end closing means is secured only to said box closure for each end of the box.

5. The self-wrapped box of claim 3, wherein one end of said box is closed by said box end closure means and said wrap end closing means prior to the box receiving an item to be boxed therewith and prior to closing the other box end.

6. The self-wrapped box of claim 1, wherein said wrap means presents a decorative outer surface.

7. The self-wrapped box of claim 6, wherein said wrap means includes an area of pressure sensitive adhesive carried by said wrap means proximate said wrap end closing means and which is disposed to coact with a last portion of said wrap end closing means to be closed to seal same in place in closed position.

8. The self-wrapped box of claim 1, wherein said wrap means is a selected material.

9. The self-wrapped box of claim 8, wherein said selected material is paper.

10. The self-wrapped box of claim 9, wherein said selected material is paper with a decorated surface.

11. The self-wrapped box of claim 8, wherein said material is foil.

12. The self-wrapped box of claim 11, wherein said foil includes a decorated surface.

13. The self-wrapped box of claim 8, wherein said wrap means is formed into a tube covering said box means so as to extend past ends of said box means and is secured to said box means only at said box closing means.

14. The self-wrapped box of claim 13, wherein said wrap means and said box means are secured together only at areas constituting no more than ten percent of the total area of said wrap means.

* * * * *